US006776680B2

(12) United States Patent
Chow

(10) Patent No.: US 6,776,680 B2
(45) Date of Patent: Aug. 17, 2004

(54) HANDHELD TOY SPINNING APPARATUS AND ASSOCIATED METHOD OF PLAY

(76) Inventor: Ki Toe Tony Chow, Unit 06, 22/F., Nanyang Plaza, 57 Hung To Road, Kwun Tong, Kowloon, Hong Kong (CN)

( * ) Notice: Subject to any disclaimer, the term of this patent is extended or adjusted under 35 U.S.C. 154(b) by 0 days.

(21) Appl. No.: 10/314,478

(22) Filed: Dec. 9, 2002

(65) Prior Publication Data

US 2004/0110446 A1 Jun. 10, 2004

(51) Int. Cl.[7] ..... A63H 1/06
(52) U.S. Cl. ..... 446/247; 446/253
(58) Field of Search ..... 446/247, 248, 446/249, 250, 251, 252, 253, 254, 256, 257, 258, 259, 260, 261, 262, 263, 264

(56) References Cited

U.S. PATENT DOCUMENTS 1,145,086 A * 7/1915 Secor ..... 446/253
1,631,539 A * 6/1927 Larrair
3,516,195 A * 6/1970 Batley
4,911,447 A * 3/1990 Pickard ..... 273/141 R
4,986,790 A * 1/1991 Boury ..... 446/253
5,512,028 A * 4/1996 Sparks, III ..... 482/92
6,120,342 A * 9/2000 Chan ..... 446/254
6,482,137 B2 * 11/2002 Walker ..... 482/110
6,530,817 B1 * 3/2003 Winslow et al. ..... 446/256
2002/0102907 A1 * 8/2002 Osawa ..... 446/256

* cited by examiner

*Primary Examiner*—Derris H. Banks
*Assistant Examiner*—Ali Abdelwahed
(74) *Attorney, Agent, or Firm*—LaMorte & Associates

(57) ABSTRACT

A toy assembly and its associated method of play. The toy assembly includes a hub. Two holes are disposed in the hub through which a loop of string is passed. By winding the string and then pulling the string taut, the string can be caused to rapidly unwind, thus rotating the hub. A removable housing is connected to the hub. The housing has a release mechanism. When the release mechanism is engaged, the housing disengages from the hub. Two players face each other and utilize their toy assemblies to cause their hubs and surrounding housings to turn. The turning housings are then brought to battle by creating contact between the spinning housings. If one housing contacts the release mechanism on another housing, the housing on the contacted toy will separate from the hub and become disabled.

19 Claims, 4 Drawing Sheets

HANDHELD TOY SPINNING APPARATUS AND ASSOCIATED METHOD OF PLAY

BACKGROUND OF THE INVENTION

1. Field of the Invention

The present invention relates to toy spinning devices that are suspended in the center of a length of string, wherein the toy device rotates as tension is selectively applied to the string.

2. Prior Art Statement

Finger suspended string spinning toys have been in existence for hundreds of years. Traditional finger suspended string spinning toys have a wooden or plastic disk, through which two holes are drilled. A loop of string is passes through the holes in the disk. The ends of the string are looped around fingers on opposite hands. Accordingly, the loop of string suspends the disk between the hands, wherein two sections of the string pass through the disk in between the hands. The disk is then rotated. As the disk is rotated, the looped string winds and contracts. By pulling the hands apart, tension is applied to the wound looped string and the looped string is caused to rapidly unwind. The disk on the looped string acts as a flywheel, wherein its rotational momentum causes the looped string to rewind in the opposite direction after the looped string becomes unwound. The looped string therefore automatically rewinds. By continuously applying tension to the looped string, the disk can be caused to continuously rotate in alternating directions.

Other than changes in material for the disk used in the center of the finger suspended string toy, finger suspended string spinning toys have changed little over time.

In the world of modern toys, old fashioned finger suspended spinning toys have only a limited amount of play value. After only a few minutes of play, a child's fascination in causing the disk to spin wanes and the child loses interest in the toy.

The present invention improves the finger suspended string spinning toy, and utilizes the improved toy in an interactive game. As such, the present invention greatly increases the play value of the toy, and thus its commercial appeal.

SUMMARY OF THE INVENTION

The present invention is a toy assembly and its associated method of play. The toy assembly includes a hub. Two holes are disposed in the hub through which a loop of string is passed. By winding the string and then pulling the string taut, the string can be caused to rapidly unwind, thus rotating the hub. A removable housing is connected to the hub. The housing has a release mechanism. When the release mechanism is engaged, the housing disengages from the hub.

Two players face each other and utilize their toy assemblies to cause their hubs and surrounding housings to turn. The turning housings are then brought to battle by creating contact between the spinning housings. If one housing contacts the release mechanism on another housing, the housing on the contacted toy will separate from the hub and become disabled.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
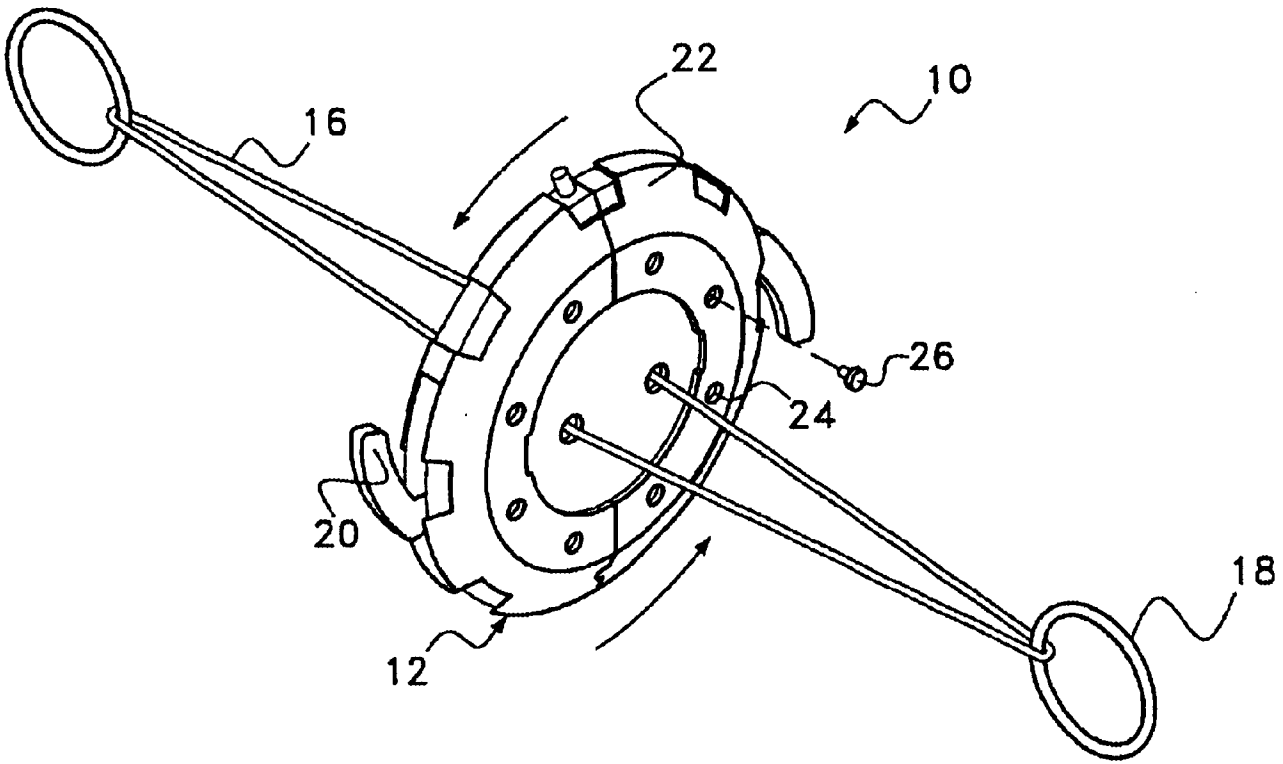
FIG. 1 is a perspective view of an exemplary embodiment of the present invention with a closed housing.

Referring to FIG. 1, an exemplary embodiment of the present invention finger suspended spinning string toy 10 is shown. In this embodiment, there is a circular disk assembly 12. Two holes 14 are eccentrically disposed through the disk assembly 12. A loop of string 16 passes through the two holes 14. Rings 18 are connected to the hooped string 16. The rings 18 are placed on fingers of opposite hands, when the toy 10 is used. As the disk assembly 12 rotates, it winds the loop of string 16, thereby shortening the effective length of the loop of string 16 between the two rings 18. By pulling the rings 18 apart with the hands, tension is applied to the loop of string 16 and the loop of string 16 is caused to rapidly unwind. Once the loop of string 16 is unwound, the disk assembly 12 still spins. Thus, the momentum of the spinning disk assembly 12 causes the just unwound loop of string 16 to rewind in the opposite direction. By periodically applying tension to the loop of string 16 by separating the rings 18, the disk assembly 12 is caused to repeatedly rotate in one direction and then another.

The disc assembly 12 of the present invention differs from traditional prior art disks in a few ways. From FIG. 1, it can be seen that arms 20 extend from the peripheral edge of the disk assembly 12. The arms 20 are connected at one end to the housing 22 of the disk assembly 12 with pivot joints. Each arm 20 is biased into the housing 22 by a small torsion spring (not shown). As the disk assembly 12 spins, centrifugal force causes the arms 20 to extend against the bias of the internal springs. As such, once the disk assembly 12 spins at a predetermined rate of revolution, the arms 20 will fully extend out from the disk assembly 12. As the disk assembly 12 slows, the arms 20 automatically retract.

In the side faces of the disk assembly 12 are located a series of receiving bores 24. The receiving bores 24 are symmetrically disposed around the geometric center of the disk assembly 12. Weight attachments 26 are provided. The weight attachments 26 have stems that pass into the receiving bores 24 with an interference fit. Accordingly, inserting the weight attachments 26 to the receiving bores 24, the weight of the disk assembly 12 is increased, as is its rotational momentum when it spins.

Figure 2:
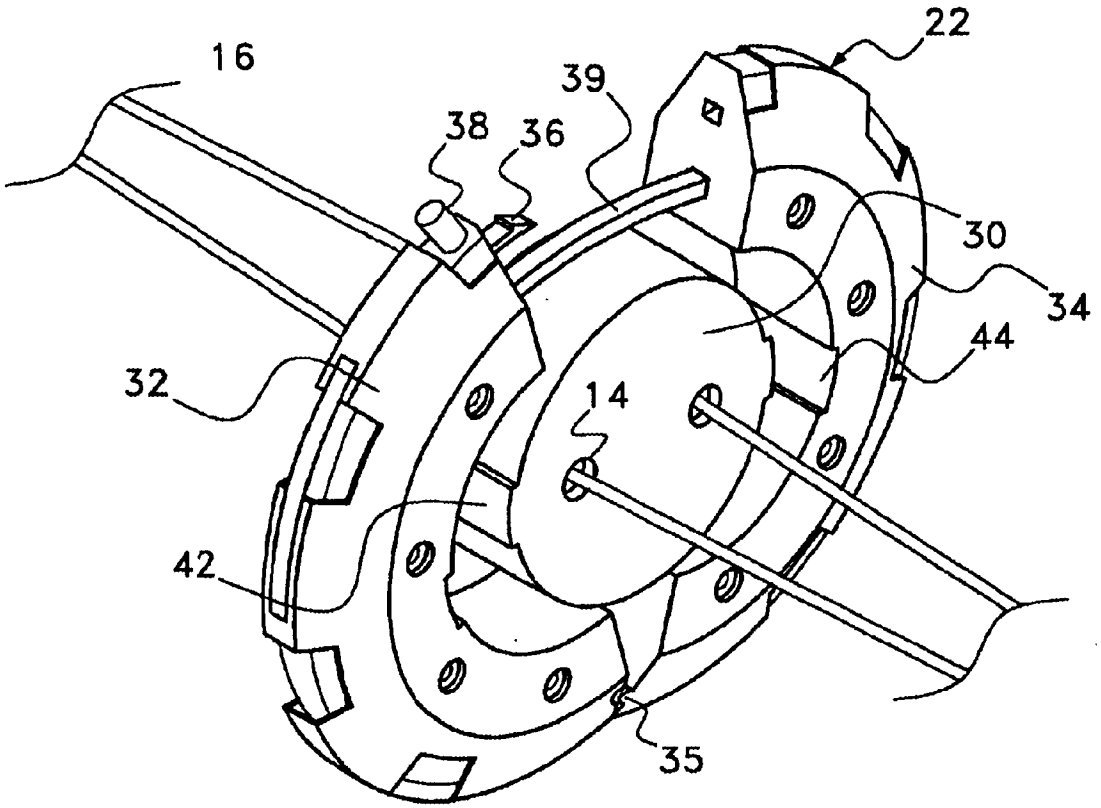
FIG. 2 is a perspective view of the embodiment of FIG. 1 with an open housing.

Referring now to FIG. 2, it can be seen that the disk assembly 12 is an assembly of component parts. The disk assembly 12 is comprised of a central hub 30. The holes 14 for the loop of string 16 are disposed through the hub 30. The central hub 30 is surrounded by an annular housing 22. The hub 30 and the annular housing 22 are keyed so that when the annular housing 22 surrounds the hub 30, the annular housing 22 mechanically engages the hub 30 and prevents either the annular housing 22 or the hub 30 from rotating independently.

The annular housing 22 is a subassembly of two semi-annular sections of housing 32, 34. The two semi-annular housing sections 32, 34 are joined together at one side with a pivot connection 35. The opposite ends of the semi-annular housing sections 32, 34 are joined together with a release mechanism that includes a locking finger 36. A safety guide 39 is also provided to prevent the two semi-annular housing sections 32, 34 from separating more than a short predetermined distance.

The locking finger 36 is controlled by a push lever 38 that terminates on the peripheral edge of the one of the semi-annular housing sections 32, 34.

The semi-annular housing sections 32, 34 snap closed forming the annular housing 22. It is only when the push lever 38 is depressed that the annular housing 22 separates and the two semi-annular housing sections 32, 34 are able to pivot part. It is when the two semi-annular housing sections 32, 34 pivot apart that the annular housing 22 is free to separate from the central hub 30. When the two semi-annular housing sections 32, 34 are in a closed condition, the semi-annular housing sections 32, 34 form a symmetrical central opening that can retain the hub 30. However, when the semi-annular housing sections 32, 34 are in an open condition, they define a non-symmetrical central opening that permits the hub 30 to disengage.

To utilize the present invention, the semi-annular sections of the housing 32, 34 are opened and the hub 30 is placed into their center. The hub 30 is oriented so that key projections 42 on the hub 30 align with key depressions 44 on the inside surface of the two semi-annular sections of housing 32, 34. Once properly positioned, the two semi-annular sections of housing 32, 34 are closed around the hub 30, thereby mechanically engaging the hub 30. The hub 30 is therefore surrounded by the annular housing 22, creating the complete center disk assembly 12, as is shown in FIG. 1.

Returning to FIG. 1, it can be seen that the loop of string 16 passes through the holes 14 in the hub. The rings 18 at the ends of the loop of string 16 are held in opposite hands. The disk assembly 12 is rotated slightly, thereby winding the loop of string 16. This contracts the loop of string 16. By momentarily pulling the rings 18 at the ends of the loop of string 16 away from each other, the loop of string 16 is caused to rapidly unwind. The unwinding loop of string 16 causes the disk assembly 12 to turn rapidly. The rotational momentum of the disk assembly 12 causes the disk assembly 12 to still spin after the loop of string 16 has unwound. This winds the loop of string 16 in the opposite direction. The rings 18 on the loop of string 16 can again be pulled and the cycle repeats.

Figure 3:
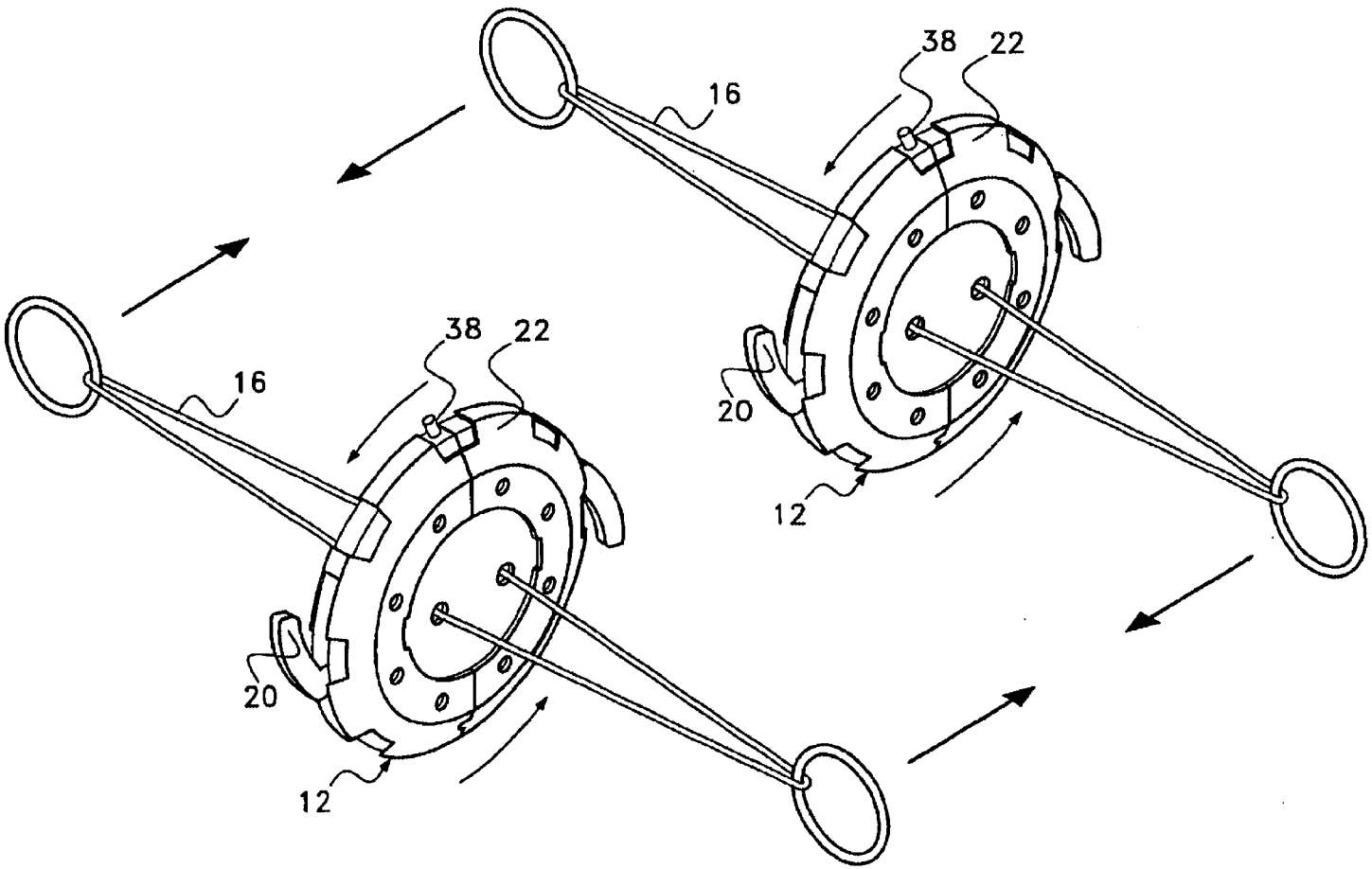
FIG. 3, is a perspective view of two examples of the present invention, illustrating a method of play.

As the disk assembly 12 spins, the centrifugal force caused by the rotation of the disk assembly 12 causes the arms 20 to extend from the disk assembly 12. The arms 20 reach their maximum extension when the disk assembly 12 rotates above at least 50% of its maximum rotational speed. The arms 20 are used in a unique method of play. Referring to FIG. 3, it can be seen that to play the game, two players are provided with different finger suspended spinning string toys 10. Each player makes the disk assembly 12 on his/her toy spin by periodically pulling the rings 18. As the disk assemblies 12 spin, the arms 20 on the disk assemblies 12 extend. The two rotating disk assemblies 12 are then brought into contact with each other. If the arm 20 on one disk assembly 12 were to strike the release push lever 38 on the other disk assembly 12, the annular housing 22 on the struck toy would open and the annular housing 22 would separate from the hub 30, thereby disabling the toy. Two players, therefore, cause their spinning disk assemblies 12 to battle until one of the disk assemblies 12 is disabled.

The safety guide 39 (FIG. 2) between the semi-annular sections of housing 32, 34 prevents the annular housing 22 from flying off the loop of string 16 once it has been opened in a battle. Accordingly, pieces do not fly away from the toy that might cause harm.

Figure 4:
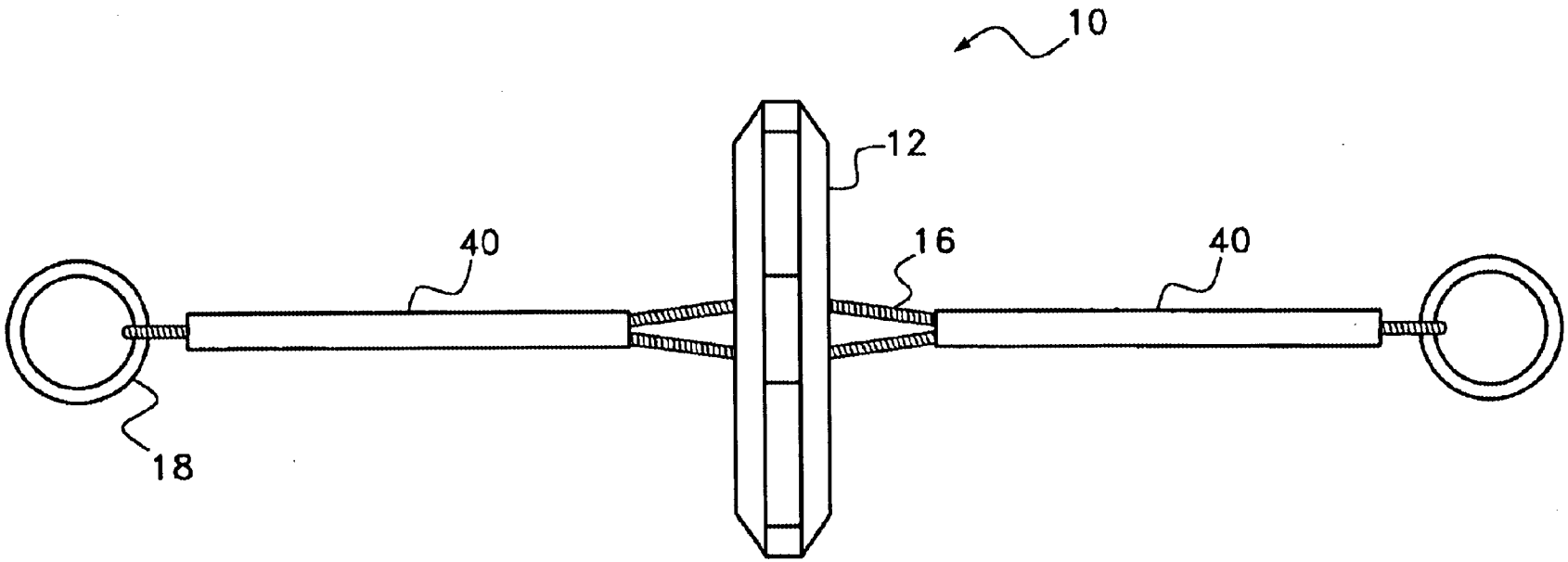
FIG. 4 is a side view of an alternate embodiment of the present invention.

Another safety system may also be present to limit the rotational speed of the disk assemblies as they spin. Referring to FIG. 4, an embodiment of the present invention finger suspended spinning string toy 10 is shown where flexible tubes 40 are placed around the loop of string 16 between the disk assembly 12 and the rings 18. The flexible tubes 40 have an internal diameter that is slightly larger than the combined thickness of the loop of string 16. As such, the loop of string 16 can wind, but the loop of string 16 is prevented from knotting up if it is over-wound. Since the flexible tubes 40 prevent the loop of string 16 from being over-wound, the flexible tubes 40 limit the amount of potential energy that can be stored in the wound loop of string 16. This, in turn, limits the amount of energy in the loop of string 16 that can be converted to rotational energy, thereby limiting the rotating speed of the disk assembly 12. By limiting the rotating speed of the disk assembly 12, it can be ensured that the plastic construction of the disk assembly 12 will not encounter forces in a battle that may cause pieces to break away and cause harm.

It will be understood that the embodiments of the present invention toy that are described and illustrated herein are merely exemplary and a person skilled in the art can make many variations to the embodiments shown without departing from the scope of the present invention. For example, the rotating disk can be made into many different configurations. Furthermore, the hub and housing that surrounds the hub can also be manufactured in many different configurations. All such variations, modifications and alternate embodiments are intended to be included within the scope of the present invention as defined by the appended claims.

What is claimed is:

1. A toy assembly comprising:

a hub having two holes disposed therethrough;

a housing for surrounding said hub, said housing having a peripheral edge, wherein said housing connects to said hub and can be selectively disconnected from said hub;

a release mechanism within said housing that is activated by at least contact point on said peripheral edge of said housing, wherein said housing disconnects from said hub when said contact point of said release mechanism is impacted; and a loop of string extending through said holes in said hub.

2. The assembly according to claim 1, further including arms coupled to said housing that extend from said housing when said housing rotates above a predetermined rate of rotation.

3. The assembly according to claim 1, further including two finger hoops, wherein said loop of string passes through a finger hoop on either side of said hub.

4. The assembly according to claim 1, wherein said housing is annular in shape, therein defining a central opening, wherein said hub connects to said housing within said central opening.

5. The assembly according to claim 1, wherein said housing contains multiple interconnected elements that can be configured in a closed configuration to define a symmetrical central opening.

6. The assembly according to claim 5, wherein said housing engages said hub when said housing is placed in said closed configuration around said hub.

7. The assembly according to claim 5, wherein said housing changes from said closed configuration to an open configuration when said release mechanism is activated, wherein in said open configuration, said multiple interconnected elements define a non-symmetrical central opening.

8. The assembly according to claim 2, wherein said arms are biased toward said housing and extend from said housing only when centrifugal force from rotation surpasses the bias.

9. The assembly according to claim 1, further including a length of tubing on either side of said hub, wherein said loop of string passes through said length of tubing.

10. The assembly according to claim 1, further including a plurality of weighted elements that are selectively attachable to said hub.

11. A method of play, comprising the steps of:

providing a first disk assembly and a second disk assembly, wherein both said first disk assembly and said second disk assembly each have a central hub, a removable housing coupled to said hub and a release mechanism for selectively causing said housing to disengage said hub;

rotating said first disk assembly and said second disk assembly;

bringing said first disk assembly in contact with said second disk assembly in an attempt to contact the release mechanism contained on said first disk assembly and said second disk assembly.

12. The method according to claim 11, wherein both said first disk assembly and said second disk assembly include a loop of string.

13. The method according to claim 12, wherein said step of rotating said first disk assembly and said second disk assembly includes periodically applying tension to said loop of string of said first disk assembly and said second disk assembly.

14. The method according to claim 11, wherein both said first disk assembly and said second disk assembly have arms that extend above a predetermined rotational speed.

15. A toy assembly, comprising:

a disk having a hub and a housing coupled to said hub, wherein said housing has a peripheral edge;

a release mechanism exposed on said peripheral edge of said housing for detaching said housing from said hub when contacted;

a mechanism for rotating said hub, wherein said housing rotates with said hub until said release mechanism is contacted during rotation and said housing detaches from said hub.

16. The assembly according to claim 15, further including arms coupled to said housing that extend from said housing when said housing rotates above a predetermined rate of rotation.

17. The assembly according to claim 15, wherein said mechanism for rotating the hub includes a loop of string that passes through said hub.

18. The assembly according to claim 15, wherein said housing contains multiple interconnected elements that can be configured in a closed configuration to define a symmetrical central opening.

19. The assembly according to claim 18, wherein said housing engages said hub when said housing is placed in said closed configuration around said hub.

* * * * *